US005120215A

United States Patent [19]

Amoros Nollas

[11] Patent Number: 5,120,215

[45] Date of Patent: Jun. 9, 1992

[54] SAFETY MECHANISMS FOR LIGHTERS

[75] Inventor: Enrique Amoros Nollas, Reus, Spain

[73] Assignee: Laforest, S.A., Tarragona, Spain

[21] Appl. No.: 416,821

[22] Filed: Oct. 2, 1989

[30] Foreign Application Priority Data

Jun. 19, 1989 [ES] Spain ..... 8902138

[51] Int. Cl.[5] ..... F23D 11/36

[52] U.S. Cl. ..... 431/153; 431/344; 222/153

[58] Field of Search ..... 431/153, 277, 129, 142, 431/144, 344; 222/153, 402.11, 384

[56] References Cited

U.S. PATENT DOCUMENTS

| | | | |
|---|---|---|---|
| 4,069,006 | 1/1978 | Jackson | 431/277 X |
| 4,786,248 | 11/1988 | Nitta | 431/153 X |
| 4,830,603 | 5/1989 | Cirami | 431/277 X |
| 4,859,172 | 8/1989 | Nitta | 431/153 |
| 4,869,662 | 9/1989 | LeCourt et al. | 431/144 X |
| 5,002,482 | 3/1991 | Fairbanks et al. | 431/153 X |

*Primary Examiner*—Carl D. Price
*Attorney, Agent, or Firm*—Darby and Darby

[57] ABSTRACT

A safety mechanism for lighters includes a lighter body having a safety lever that is actuated from outside the body by acting upon a tongue passing through a L-shaped window in the body. The safety lever, which is mounted as a torsion spring, normally occupies a position in the L-shaped window with the tongue at the end of the horizontal leg of the window. In that position, the pushbutton and the upper edge of the safety lever are in substantial abutment and operation of the lighter is not possible. When the tongue is moved to the other end of the L-shaped window, the tongue is in alignment with a recess provided in the pushbutton such that the pushbutton is free to move. After lighting is accomplished and the pushbutton is released, the tongue recovers automatically to the safety position.

4 Claims, 1 Drawing Sheet

SAFETY MECHANISMS FOR LIGHTERS

BACKGROUND OF THE INVENTION

Presently, all lighters of the piezoelectric lighting type, as well as the pyrophoric or battery types, etc., contemplate an easy and rapid lighting device, improved in that it is only necessary to exert simple pressure on a pushbutton.

On one hand, it implies an advantage in lighting due to its extreme speed of operation. However, there is a noteworthy lack of safety for the user who carries such a device, since in an unforeseeable involuntary action, the lighter can light up accidentally, or at least give rise to a gas leak with the consequences that such a leak causes.

SUMMARY OF THE INVENTION

The present invention refers to a safety mechanism for lighters that assures that the lighter cannot be lit accidentally. The lighter requires the user's total attention every time he wishes to light it. He must pay attention to the lighter since it always has to be conditioned or preset before lighting it. The mechanism automatically returns to its blocking or safe position after this lighting operation.

With this mechanism, it is impossible that the lighter light up accidentally due to an involuntary pressure exerted on the pushbutton when the lighter is kept in one's pocket, especially when the lighter is of the piezoelectric lighting type.

In order to preset the mechanism, it is necessary to effect two movements perpendicular to each other of an element defined as a safety lever. This requirement is very effective to prevent the lighter being lit by children.

Another object of the invention is to prevent a condition where the lighter cannot be lit due to a lack of recovery of the pushbutton after a first pushbutton actuation. This failure to recover initial or standby position can happen due to an accumulation of dirt, or simply due to sand in the mechanism.

In order to obtain the proposed objectives, the safety mechanism for lighters, which makes up the object of the invention, and which is especially used when the lighting system is of the piezoelectric type, includes a safety lever having a tongue which passes through an L-shaped window in the body of the lighter. That is, the window is in the wall of the housing wherein the pushbutton for lighting moves and is vertically guided. The safety lever is actuated from outside the housing.

The L-shaped window is oriented with the vertical leg of the L-shape being parallel to the motion of the pushbutton in operation, and the horizontal leg of the L-shape is transverse to the vertical leg and to the motion of the pushbutton.

The safety lever is normally positioned with its tongue located at the free closed end of the horizontal leg of the L-shaped window. This position corresponds to the safety or block position because the pushbutton cannot move vertically as the top edge of the safety lever is in contact with the bottom edge of the pushbutton. The tongue is automatically biased so that it occupies this blocking or safety position.

In order to preset the mechanism so that lighting may be effected, it is necessary to move the tongue from the free closed end of the horizontal leg in two orthogonal movements so that it leaves the free end of the horizontal legs moves to the joint between the vertical and horizontal legs and then moves along the vertical leg to the free closed end of that vertical leg. When the tongue is located at the free end of the vertical leg, the top edge of the safety lever no longer abuts a bottom edge of the pushbutton but is located in a position which faces a recess that exists in the pushbutton. Thus, it is possible to move the pushbutton downward, that is, toward the horizontal leg of the L-shape without interference with the safety lever.

After using the flame of the lighter, the pushbutton is released, the safety lever automatically returns to the blocking or safety position because approaching the end of the operational stroke of the pushbutton, in the act of lighting, the tongue of the safety lever is acted upon by the pushbutton itself and is moved vertically from the free closed end of the vertical leg in the L-shaped window until it is at the joint aligned with the horizontal leg of the L-shaped window. When the pushbutton returns to its original position, the safety lever remains in alignment with the horizontal leg of the window. At this position, the automatic biasing of the tongue forces the tongue to its original starting position at the free closed end of the horizontal leg of the window.

The pushbutton has vertically oriented grooves in its side wall, that is, oriented in the direction of pushbutton motion, in order to reduce the contact surface between the pushbutton and the housing or body of the lighter and reduce friction so that recovery of the pushbutton is assured. Thus, closing of the gas valve in the lighter is also properly effected and motion of the safety lever to the safety position is effectively accomplished.

DESCRIPTION OF THE PREFERRED EMBODIMENT

Figure 4:
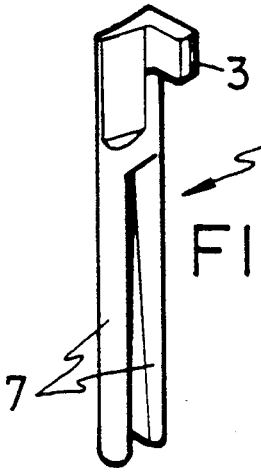
FIG. 4 is a perspective view of the safety lever.

With reference to the Figures, the safety mechanism for lighters in accordance with the invention includes a safety lever 1 having a geometry best illustrated in FIG. 4. At one end of the lever 1 is a protruding tongue 3 and at the other end of the elongated lever 1 are two feet 7 separated by a groove. The lever is made such that when the feet 7 are constrained, the tongue 3 may moved, thereby subjecting the lever to torsional stress.

The safety lever 1 is positioned in the inside of the body 2 of the lighter in such a way that the tongue 3 extends from the body 2 of the lighter through an L-shaped window 4 at the rear of the lighter.

Figure 1:
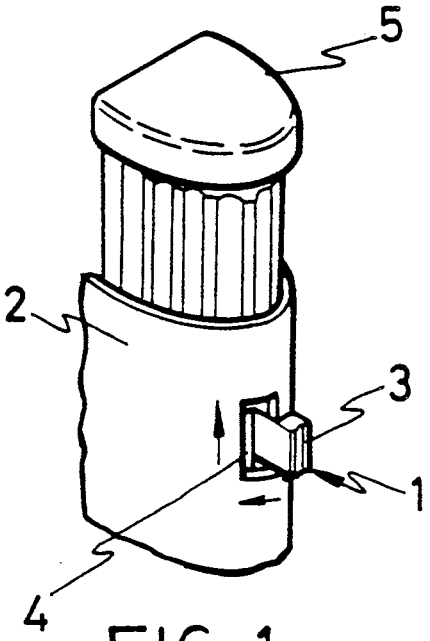
FIG. 1 is a partial perspective view of a lighter provided with the safety mechanism object of the invention, showing only the area of the same where said mechanism is located.
Figure 2:
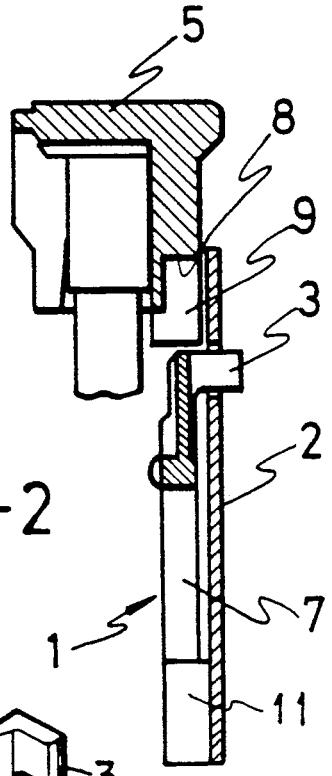
FIG. 2 is a longitudinal elevational section of what is shown in FIG. 1.
Figure 3:
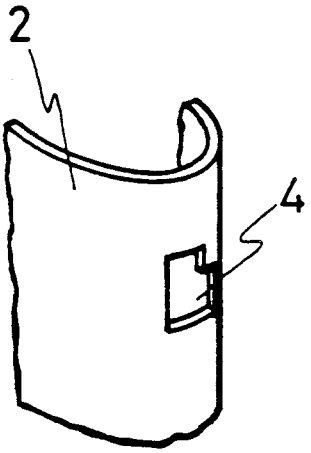
FIG. 3 is a partial perspective view of the body of the lighter in the area where there is an L-shaped window in which the safety lever is guided.

In the position shown in FIG. 1, movement of the pushbutton 5 into the body 2 in the longitudinal direction is blocked and production of a spark coming from a piezoelectric device and also the opening of a gas valve, are avoided. In this blocked or safety position, as illustrated in FIG. 1. the tongue 3 is located in the horizontal leg of the L-shaped window. In this position, as illustrated in FIG. 2. the lower edge of the pushbutton 5 is practically in contact with the upper edge of the safety lever 1, thus preventing the downward motion of the pushbutton, at least, while the control tongue 3 is in the position illustrated in FIG. 1.

The pushbutton 5 is provided with recesses that accommodate the safety lever 1 when the lever 1 is placed in the position where lighting may be effected.

This lighting position of the safety lever 1 is obtained upon moving the control tongue in two perpendicular directions following the outline of the L-shaped window 4 as indicated by the arrows of FIG. 1. When starting from the blocking position illustrated in FIG. 1, the control tongue 3 is accidentally pressed toward the left (FIG. 1), upon removal of the cause of such displacement, the tongue 3 and therefore the lever 1 returns to its initial blocking or safety position (FIG. 1). This occurs because in moving out of the horizontal leg of the window, a torsional stress is induced by turning of the tongue 3 relative to the feet 7 that are constrained in the body by a constraint 11. If the accidentally applied force only moves the tongue 3 of the lever 1 along the horizontal leg in the window 4, then upon release of the accidental force, the torsion in the lever 1 returns the lever 1 to the position shown in FIG. 1 with the tongue at the free closed end of the horizontal window leg.

Figure 5:
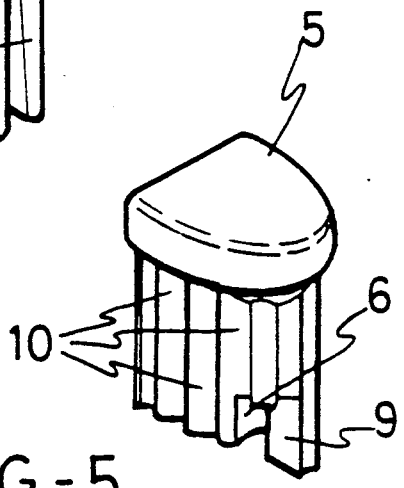
FIG. 5 is a perspective view of the pushbutton of the lighter provided with a groove or recess in which the top part of the safety lever is subject to entry.

An intentional preparation or presetting of the lighter so that lighting can be effected requires first that the control tongue 3 be moved horizontally in the horizontal leg of the L-shaped window so that it comes into alignment with the vertical leg of the window 4. Then, the tongue is pushed upward until it is blocked by the free closed end of the vertical leg of the window. In this position, the top edge of the safety lever 1 is no longer opposed to the bottom edge of the pushbutton 5 but rather is positioned in alignment with a recess 6 (FIG. 5) formed in the bottom of the pushbutton 5. Thus, the recess 6 provides clearance between the safety lever 1 and the pushbutton 5 so that the pushbutton can be moved vertically downward toward the window.

During lighting, when the pushbutton 5 moves down, there is a moment when the top wall 8 of the recess 6 contacts the top edge of the safety lever 1 such that further downward motion of the pushbutton 5 forces the lever 1 to follow and move the tongue 3 downward along the vertical leg of the L-shaped window 4. When the pushbutton 5 is depressed, the side wall 9 of the recess 6 prevents the tongue 3 from re-entering the horizontal leg of the L-shaped window. The side of the lever 1 rests against the sidewall 9. When the pushbutton returns to its original upward position, the surface 9 no longer obstructs the lever tongue 3, and the lever elastically reverts to the position indicated in FIG. 1 by the tongue moving along the horizontal leg, to the free closed end, of the L-shaped window 4. The lever 1 returns automatically to its blocking or safety position after use of the lighter, thus fulfilling the required safety function. This occurs as a result of the torsional stress to which the lever 1 was previously subjected in presetting the lighter for operation.

The pushbutton 5 includes vertical grooves 10 on its sides to eliminate friction during movement of the pushbutton as described above and to permit easy recovery to the starting position. Thus, closing the gas valve and entry of the tongue 3 of the lever 1 to the blocking position are assured.

I claim:

1. A lighter with a safety mechanism comprising:

a pushbutton for actuating said lighter, said pushbutton having a recess nd being capable of translation in a first direction from a standby position to a depressed position for lighting said lighter;

a body having a space therein for partially containing and guiding said pushbutton, said body having an L-shaped window providing access to said space, said L-shaped window including a first window leg extended transversely to said first direction and a second window leg extended parallel to said first direction, said legs intersecting to form said window;

a safety lever within said body and positioned generally parallel to said first direction, said safety lever being of extended length and having a tongue proximate said pushbutton at one longitudinal end of said lever, said tongue extending transversely to said lever and externally of said body through said window, said tongue blocking movement of said pushbutton in said first direction when said tongue is at a first position located in said first window leg, said pushbutton being moveable from said standby position in said first direction when said tongue is at a second position located in said second window leg, said tongue being accessible and movable from said first position to said second position by application of an external force by a user of said lighter, a portion of said lever being received in said pushbutton recess when said tongue is moved to said second position, the other longitudinal end of said lever opposite to said one lever end being unable to turn in said body, wherein moving said tongue from said first position to said second position causes twisting of said lever about said other end and produces a torsional stress in said lever, said stress biasing said lever to return said tongue toward said first position.

2. A lighter as in claim 1, wherein said lever is mounted for lengthwise translation in said body, a surface of said recess on said pushbutton contacting said lever and moving said lever in said first direction with translation of said pushbutton is said first direction;

said torsional stress automatically returning said tongue to said first position after said pushbutton returns to said standby positioning by movement of said pushbutton in a second direction opposite to said first direction.

3. A lighter as in claim 1, wherein said lever is bifurcated at said other end away from said tongue into two feet with a space therebetween.

4. A lighter as in claim 1, wherein said pushbutton includes grooves in a side surface thereof, said grooves extending in said first direction and reducing friction between aid pushbutton and said body by reducing the contact area between them.

* * * * *